United States Patent [19]

Miyamoto

[11] 4,449,433

[45] May 22, 1984

[54] CUTTING DEVICE FOR TAG WEB

[75] Inventor: Takehiko Miyamoto, Tokyo, Japan

[73] Assignee: Kabushiki Kaisha Sato, Japan

[21] Appl. No.: 351,459

[22] Filed: Feb. 23, 1982

[30] Foreign Application Priority Data

Feb. 23, 1981 [JP] Japan ..... 56-24234

[51] Int. Cl.[3] ..... B26D 5/20

[52] U.S. Cl. ..... 83/76; 83/299; 83/371; 83/372

[58] Field of Search ..... 83/76, 299, 371, 372

[56] References Cited

U.S. PATENT DOCUMENTS

| | | | |
|---|---|---|---|
| 2,228,300 | 1/1941 | Cohen | 83/299 |
| 2,250,209 | 7/1941 | Shoults et al. | 83/76 X |
| 2,995,968 | 8/1961 | Tomberg | 83/76 X |
| 3,084,579 | 4/1963 | Melville | 83/299 X |
| 3,105,405 | 10/1963 | Bessonny | 83/76 X |
| 3,175,441 | 3/1965 | Drenning et al. | 83/76 |
| 3,736,821 | 6/1973 | Obenshain | 83/76 |
| 3,742,798 | 7/1973 | Gries | 83/299 X |
| 3,889,939 | 6/1975 | Faltin | 83/76 X |
| 4,384,500 | 5/1983 | Friberg | 83/76 X |

*Primary Examiner*—Frank T. Yost

*Attorney, Agent, or Firm*—Ostrolenk, Faber, Gerb & Soffen

[57] ABSTRACT

Herein disclosed is a cutting device for use in a tag printer or the like, in which a tag web being fed is cut, while its cut position is continuously corrected by a rotary blade so that it can cut a variety of price tag webs having different cutting pitches or intervals. The rotary blade is rotated continuously through a differential gear mechanism by a first motor. Its cutting timing is suitably corrected by a second motor which is connected to the differential gear mechanism. Before the cutting operation, moreover, both the price tag web and the rotary blade are positioned at their respective reference positions. During cutting, information as to the positions of the tags on the web and the rotary blade are fed to a processor which adjusts the rotation of the blade for effecting cutting at the proper positions along the web.

13 Claims, 7 Drawing Figures

Navy Blue
AY Type $ 58000
P123
P123
V567
$58000
F
1
2
3
4
5
6
10
11
12
13
14
15
16
17
18
19
20
21
22
23
24
25
26
27
28
29
30
40
41
42
SW
S1

CUTTING DEVICE FOR TAG WEB

FIELD OF THE INVENTION

The present invention relates to a cutting device for cutting lengths from an elongate web, particularly for use in a price tag printer and, more particularly, relates to a cutting device of the above type, in which a price tag web is cut into price tags by the coactions of stationary and rotary blades.

BACKGROUND OF THE INVENTION

There are various price tag printers for printing desired indicia on a price tag web. Specifically, in one printer, a printing head set with types is reciprocally carried with respect to the price tag web on a platen to perform the printing operation. In another printer, types are brought to impact upon the price tag web by a printing hammer.

With either of those popular price tag printers, the feed of the price tag web has to be stopped during the printing operation. In the cutting operation, moreover, a rotary blade is rotationally driven to cut the price tag web after this web has been stopped at its proper cut position. It is, therefore, necessary to feed the price tag web intermittently such that it is stopped at its proper positions during both the printing and the cutting operations. As a result, it is quite difficult to speed up the printing operation.

Considering this difficulty, if a printing system is used in which the price tag web can be printed while being fed, such as an electrostatic printing system, and if the cutting device is constructed so that the price tag web being fed is cut by rotating the rotary blade at all times, then the price tag web can be continuously fed so that it can be printed at a high speed.

Nevertheless, since the rotary blade construction is frequently used, it creates the problem that the displacement in the cutting position has to be eliminated. In order to make it possible to cut many kinds of price tag webs having different cutting pitches or intervals, the cutting timing has to be changed to adjust for the cutting pitches.

SUMMARY OF THE INVENTION

An object of the present invention is to provide a cutting device for a tag web, in which a tag web that is being fed is also being cut, while its cutting position is corrected at all times. Such cutting is accomplished by always rotating a rotary blade so that it can cut a variety of price webs having different cutting pitches or intervals.

In the cutting device according to the present invention, the rotary blade is rotated through a differential gear mechanism by a first motor and the cutting timing is suitably corrected by the action of a second motor which is connected to that differential gear mechanism.

The present invention provides a cutting device for use in a price tag printer. It includes a feed device for continuously feeding a price tag web. The web is formed at an interval equal to the length of one price tag with portions to be detected. There is a printing device for printing the price tag web being fed. The cutting device comprises a stationary blade disposed midway and in the vicinity of the passage of the price tag web. A rotary blade is disposed to face the stationary blade and coacts with the stationary blade for cutting the price tag web into individual price tags. A first motor rotates the rotary blade continuously. A first power transmission mechanism is connected to the first motor for transmitting its rotation. A differential gear mechanism is connected to both the first power transmission mechanism and to the rotary blade for rotating the latter when it receives the rotation of the first motor through the power transmission mechanism. Timing control means corrects the cutting timing of the rotary blade. The timing control means include a second motor which is rotatable independently of the first motor. A second power transmission mechanism is connected to both the second motor and to the differential gear mechanism for transmitting the correcting rotations of the second motor to the rotary blade. A detector detects the presence of a price tag at a position at which it is to be cut, compares this with the separately detected rotary position of the blade and adjusts the rotation rate of the blade so that the web will be cut at the end of each tag.

BRIEF DESCRIPTION OF THE DRAWINGS

Other objects and features of the present invention will become apparent from the following description taken in conjunction with the accompanying drawings, in which:

FIGS. 6 and 7 are diagrams for explaining the correcting operation of the cutting timing of the cutting device, wherein FIG. 6 shows the state of the rotary blade of the cutting device, and FIG. 7 is a flow chart of the corrections of the rotary blade.

DESCRIPTION OF THE PREFERRED EMBODIMENT

The present invention will now be decribed in detail with reference to the accompanying drawings.

Figures 1, 2:
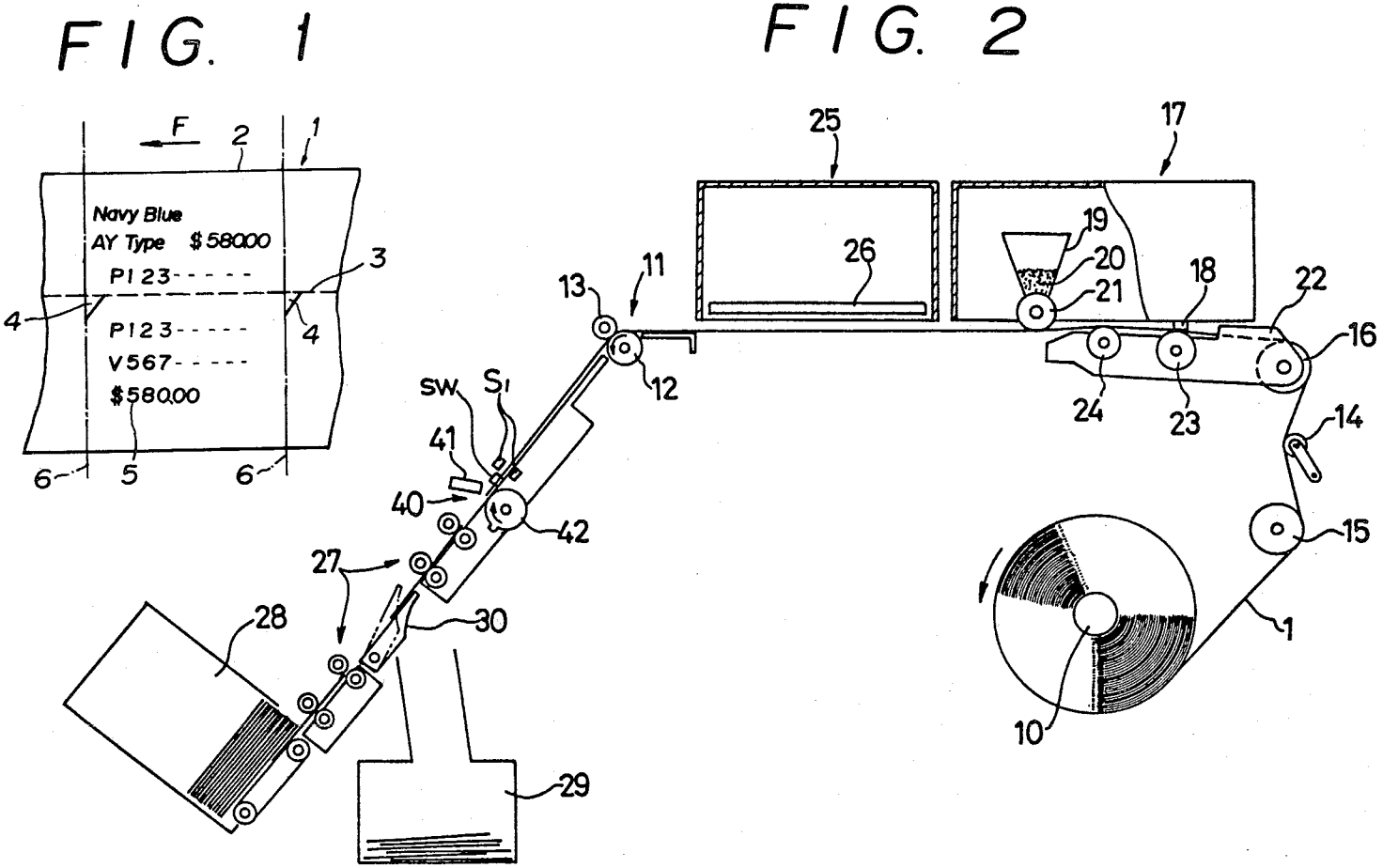
FIG. 1 is a top plan view of a price tag web.
FIG. 2 is a schematic side elevation showing the overall construction of a price tag printer.

In FIG. 1, a series of tags are arranged as a price tag web 1. The price tag web 1 is formed at its widthwise center portion with both a series of separating perforations 3, which extend in the feeding direction of the tag web 1, indicated by arrow F, and a series of holes or other portions 4 to be detected, which are arranged in that feeding direction at an interval corresponding to the length of each price tag 2. The portions 4 to be detected need not necessarily be the illustrated holes, but may be magnetized portions, printed marks, or the like. On the other hand, if the price tag web 1 is not a continuous one like that shown in FIG. 1, but is instead a composite label web which is composed of a web of backing paper and a series of labels temporarily adhered at a suitable spacing to that backing paper web, then the spacings between adjacent labels may be used as those portions 4 to be detected.

Each of the surface portions of the price label web 1, which correspond to the price tags, are respectively printed with indicia which are composed of human readable letters, OCR characters, and so on. Lines indicated at phantom lines correspond to the lines 6 which are to be cut by a later-described cutting device 40.

FIG. 2 shows the price tag printer which uses an electrostatic printing system.

A price tag supply roll 10 holds the price tag web 1 in a rolled form, before it is printed, and the roll 10 supplies the web and applies a suitable physical load to the web. A feed device 11, which is comprised of a capstan roller 12 and an opposing pinch roller 13, unrolls the price tag web 1 from the supply roll 10 and feeds it continuously at a constant speed.

After being unrolled from its supply roll 10 by the feeding operation of the feed device 11, the price tag web 1 is guided by an uncurling roller 14 and two guide rollers 15 and 16 and then passes below a printing device 17. The printing device 17 is equipped with both an electrostatic head 18 for forming the respective regions of the price tag web 1 with an electrostatic latent image corresponding to an indicia pattern to be printed and a toner roller 21 for applying the toner 20 in a toner box 19 to the portions formed with that electrostatic latent image. A roller supporting member 22 supports a pressure roller 23 and a guide roller 24 such that the former roller presses the price tag web 1 onto the electrostatic head 18, whereas the latter roller guides the price tag web 1 into contact with the toner roller 21. The now printed price tag web 1 with the desired indicia 5 passes below a fixing device 25. This fixes the indicia 5 on the price tag web 1 with a heater 26.

The price tag web 1 next reaches the cutting device 40 according to the present invention after it has passed through the feed device 11. The cutting device 40 is equipped with a stationary blade 41 and with a facing, opposing rotary blade 42 which is always rotating. The blade is a cylinder with a cutting blade on its periphery extending along its rotation axis. The rotary blade 42 is constructed so that it consecutively cuts the price tag web 1 into pieces or price tags 2 having a predetermined length. A transparent type photoelectric detector $S_1$ detects the portions 4 of the price tag web 1 and is used to correct the cutting timing of the rotary blade 42. A limit switch SW detects the presence of the price tag web 1 and positions the price tag web 1 at a predetermined reference position.

The cut price tags 2 are selectively transferred to a stacker 28 or to a useless tag box 29 by a transfer device 27. The selections between the stacker 28 and the tag box 29 are performed by a swinging selecting member 30.

Figure 3:
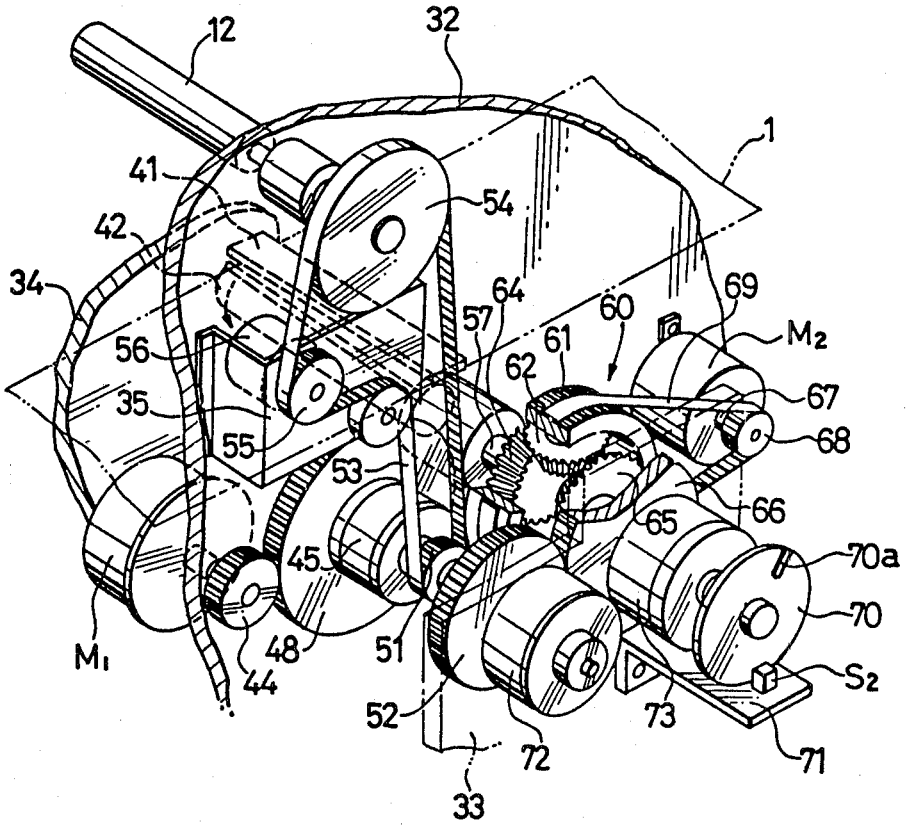
FIG. 3 is a perspective view of a cutting device according to the present invention.
Figure 4:
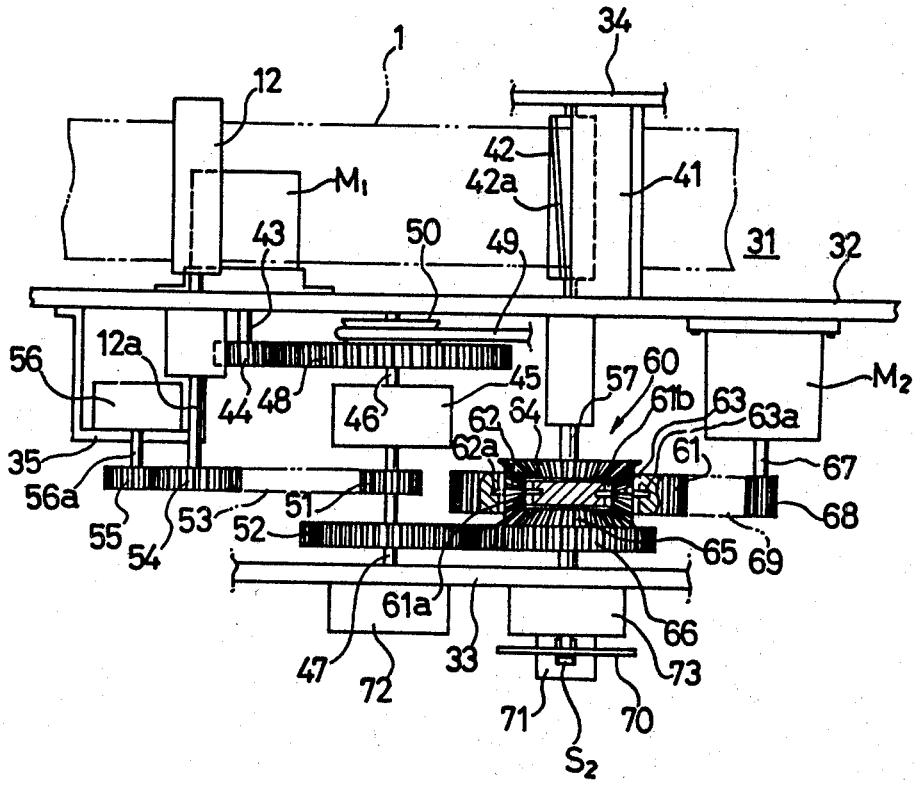
FIG. 4 is a top plan view showing the power transmitting connections of the cutting device of FIG. 3.

The cutting device 40 of the price tag printer is now described with references to FIGS. 3 and 4. On a printer body 31, two mounting plates 32 and 33 are erected for mounting a variety of parts. Mounting members 34 and 35 are fixed to one side and the other side, respectively, of the mounting plate 32. An induction motor $M_1$ is mounted on the mounting plate 32 for driving all the aforementioned feed and transfer devices 11 and 27 and the rotation of the rotary blade 42 of the cutting device 40.

A spur gear 44 is fixed to the drive shaft 43 of the induction motor $M_1$. Rotary shafts 46 and 47 are arranged between the mounting plates 32 and 33. The shafts are connected through a clutch 45. More specifically, one end of the rotary shaft 46 is carried in the mounting plate 32 and the other end is connected to one side of the clutch 45. One end of the rotary shaft 47 is carried in the mounting plate 33 and the other end is connected to the other side of the clutch 45. A spur gear 48 is fixed to the rotary shaft 46. The gear 48 meshes with the spur gear 44. A pulley 50, which is fixed to the shaft 46, is connected through a rope belt 49 to the transfer device 27. When the induction motor $M_1$ is started by a power source (not shown), it rotates the rotary shaft 46 which starts the transfer device 27 operating. Simultaneously with the start of the printing operation, the clutch 45 is applied to connect both the rotary shafts 46 and 47 so that the shaft 47 rotates together with the shaft 46.

A timing pulley 51 and a spur gear 52 are fixed to the rotary shaft 47. The timing pulley 51 is connected through a timing belt 53 to other timing pulleys 54 and 55. The timing pulley 54 is fixed to the roller shaft **12*a* of the capstan roller 12, which is carried on the mounting plates 32. The other timing pulley 55 is fixed to the shaft 56*a* of a rotary encoder 56 which is mounted on the mounting member 35. When the rotary shaft 47 is rotated at the beginning of the printing operation, the feed device 11 begins its operation, and the rotary encoder 56 is driven. The rotary encoder 56 generates a signal each time corresponding to 1/N rotations of the rotary blade 42**, where N stands for a sufficiently large natural number.

The stationary blade 41 is fixedly held by the mounting plate 32 and the mounting member 34. The rotary blade 42 has an edge **42*a* on its outer circumference. The blade 42 is carried in the mounting plate 32 and the mounting member 34. The rotary blade 42 has one end connected to a rotary shaft 57 which is carried in the mounting plate 32 and the mounting plate 33**.

On the rotary shaft 57, a differential gear mechanism 60 is mounted. It is comprised of a timing pulley 61 acting as a ring gear, a pair of bevel gears 62 and 63 acting as differential pinion gears and a pair of bevel gears 64 and 65 acting as differential side gears.

The timing pulley 61 is rotatably supported by the rotary shaft 57. The pulley is formed with gear bearing holes **61*a* and 61*b* at its diametrically opposite inner walls. The bevel gears 62 and 63 are respectively carried in the gear bearing holes 61*a* and 61*b* such that their respective shafts 62*a* and 63*a* are rotatably carried in the timing pulley 61. The bevel or side gear 64 is arranged at that side of the timing pulley 61 which corresponds to the rotary blade 42. The gear 64 is in meshing engagement with the two bevel or pinion gears 62 and 63. The bevel gear 64 thus arranged is fixed to the rotary shaft 57 so that it can rotate integrally with it. The other bevel or side gear 65 is located at the other side of the timing pulley 61. The gear 65 is fixed to the side portion of a spur gear 66 and is in meshing engagement with the two bevel or pinion gears 62 and 63. Moreover, the spur gear 66, to which that bevel gear 65 is fixed, is rotatably supported by the rotary shaft 57 and is made to mesh with the aforementioned spur gear 52**.

A pulse motor $M_2$ is mounted on the mounting plate 32. The motor $M_2$ is used partly to correct the cutting timing by the rotary blade 42 and partly to position both the price tag web 1 and the rotary blade 42 at preset reference positions before the start of the printing operation. A timing pulley 68 is fixed to the drive shaft 67 of the pulse motor $M_2$. The pulley 68 is connected to the timing pulley 61 of the differential gear mechanism 60 by means of a timing belt 69.

A disc 70 is fixed to the rotary shaft 57. The disc includes a notch **70*a*. A transparent type photoelectric detector $S_2$ is fixed to a mounting member 71 which is integral with the mounting plate 33. When the photoelectric detector $S_2$ detects the notch 70***a* of the disc 70, the rotary blade 42 is positioned at its preset position.

A brake 72 is fixed to the mounting plate 33 to depress the rotation of the rotary shaft 57 when the rotary blade 42 is to be positioned at its reference position by the pulse motor $M_2$. Another brake 73, which is fixed to the mounting plate 33, is used to depress the rotation of the rotary shaft 57 when the price tag web 1 is to be positioned at its reference position by the same pulse motor $M_2$.

The operations for positioning both the price tag web 1 and the rotary blade 42 at their respective reference positions before the start of the printing operation is now described. First, the brake 73 is actuated to brake the rotation of the rotary shaft 57, while the pulse motor $M_2$ is energized to rotate the timing pulley 61 clockwise, as viewed in FIG. 3. Clockwise rotation of the timing pulley 61 rotates only one bevel or side gear 65 clockwise, while the other bevel or side gear 64 is left non-rotating. Rotation of the bevel gear 65 is transmitted to the capstan roller 12 of the feed device 11 so that the price tag web 1 is fed to advance. When the price tag web 1 acts upon the limit switch SW, the pulse motor $M_2$ is stopped in response to the output signal of that limit switch SW so that the price tag web 1 is positioned at its reference position.

Next, the brake 73 is released, while the brake 72 is applied to brake the rotation of the rotary shaft 47. Then, the pulse motor $M_2$ is energized to rotationally drive the timing pulley 61 in the reverse, counter-clockwise direction, as viewed in FIG. 3. The counter-clockwise rotation of the timing pulley 61 rotates only one bevel or side gear 64 counter-clockwise, while the other bevel or side gear 65 is left non-rotational. The bevel gear 64 rotates both the rotary blade 42 and the disc 70. When the photoelectric detector $S_2$ detects the notch 70*a* of the disc 70 and thereby generates a signal, the pulse motor $M_2$ is stopped in response to that output signal so that the rotary blade 42 is positioned at its reference position. During the operations thus far described, the connection between the rotary shafts 46 and 47 is blocked by disengagement of the clutch 45.

Now the price tag web 1 and the rotary blade 42 are positioned at their respective reference positions. When the induction motor $M_1$ is started and there is a connection between the rotary shafts 46 and 47 through the engagement of the clutch 45, the spur gear 52 is rotated in the counter-clockwise direction, as viewed in FIG. 3. The counter-clockwise rotation of the spur gear 52 causes both the spur gear 66 and the bevel or side gear 65 to rotate in the clockwise direction and this rotates the paired bevel or pinion gears 62 and 63 of the timing pulley 61 accordingly. These rotations of the paired bevel or pinion gears 62 and 63 rotates the other bevel or side gear 64 fixed to the rotary shaft 57 in the counter-clockwise direction. As a result, the rotary blade 42 is accordingly rotated in the counter-clockwise direction so that the price tag web 1 is consecutively cut at proper positions.

Moreover, in case there is an error at the cut positions of the price tag web 1 by the rotary blade 42, it is corrected by energizing the pulse motor $M_2$. More specifically, in case the cutting timing by the rotary blade 42 is too fast, the drive shaft 67 of the pulse motor $M_2$ is rotated in the clockwise direction, as viewed in FIG. 3. Then, the timing pulley 61 is accordingly rotated in the clockwise direction so that the bevel or side gear 64 is returned clockwise to an extent corresponding to the rotation of the timing pulley 61 while that pulley is being rotated counter-clockwise by the induction motor $M_1$. As a result, the cutting timing by the rotary blade 42 is retarded to an extent corresponding to the clockwise rotation of the timing pulley 6.

In case the cutting timing by the rotary blade 42 is too slow, on the other hand, the drive shaft 67 of the pulse motor $M_2$ is suitably rotated clockwise, as viewed in FIG. 3. Then, the timing pulley 61 is accordingly rotated in the counter-clockwise direction so that the bevel or side gear 64 is further rotated counter-clockwise to an extent corresponding to the rotation of the timing pulley 61 while it is being rotated counter-clockwise by the induction motor $M_1$. As a result, the cutting timing of the rotary blade 42 is advanced to an extent corresponding to the counter-clockwise rotation of the timing pulley 61.

An error at the cut positions of the price tag web 1 by the rotary blade 42 may arise from a number of causes. When a variety of price tag webs 1 having different cutting pitches or intervals are to be cut, it becomes necessary to correct the cutting timing of the rotary blade 42 for matching those cutting pitches. Also, the discrepancy between the feed time corresponding to the cutting pitches of the price tag web 1 used and the time interval of the cutting operation by the rotary blade 42 is gradually enlarged by slippage, or the like, during the feeding operation, even if the feed time and the time interval are adjusted to be theoretically coincident. In this case, it is also necessary to monitor that discrepancy at all times.

The following description is directed to a control circuit for energizing the pulse motor $M_2$ to control the cutting operations in accordance with the output signals from the rotary encoder 56 and the photoelectric detectors $S_1$ and $S_2$ so that the cutting timing by the rotary blade 42 may be corrected.

Figure 5:
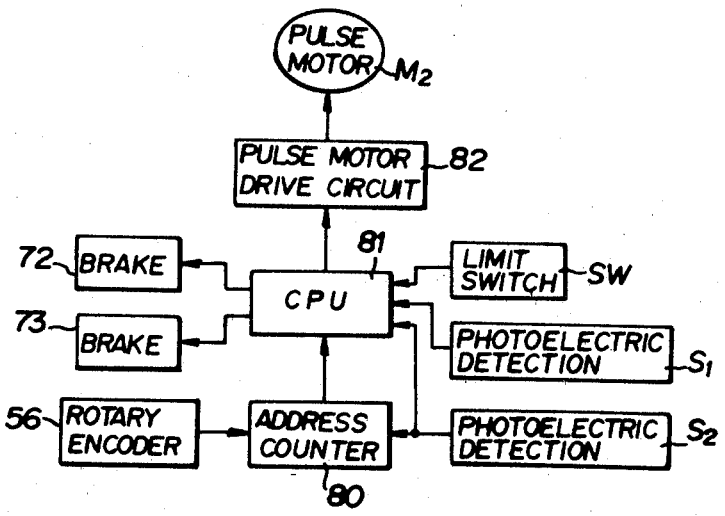
FIG. 5 is a block diagram showing a control circuit for controlling the operations of the cutting device shown in FIGS. 3 and 4.

Turning to FIG. 5, an address counter 80 is used to indicate the position of the rotary blade 42 in terms of its counted value. Here, an error in a corrected quantity is caused between the position of the rotary blade 42 after it has been corrected by the pulse motor $M_2$ and the counted value of the address counter 80. This address counter 80 is adapted to be counted up by the pulse signals, which are generated sequentially at an identical interval by the rotary encoder 56, and to be reset by the output signal of the photoelectric detector $S_2$.

A central processing unit or CPU 81, which is equipped with a programmed microprocessor, receives both the counted value from the address counter 80 and the output signals from the photoelectric detectors $S_1$ and $S_2$ and the limit switch SW. To position the price tag web 1 and the rotary blade 42 at their respective reference positions, the CPU 81 controls not only the brakes 72 and 73 but also a pulse motor drive circuit 82, thereby to suitably energize the pulse motor $M_2$ while monitoring the input signals coming from the photoelectric detector $S_2$ and the limit switch SW. The CPU 81 also calculates the corrected value on the basis of the input information coming from the photoelectric detectors $S_1$ and $S_2$ and the address counter 80 and feeds the calculated corrected value to the pulse motor drive circuit 82. Moreover, the pulse motor drive circuit 82 rotationally drives the pulse motor $M_2$ to a predetermined extent and in a predetermined direction in accordance with the corrected value received.

Figure 6:
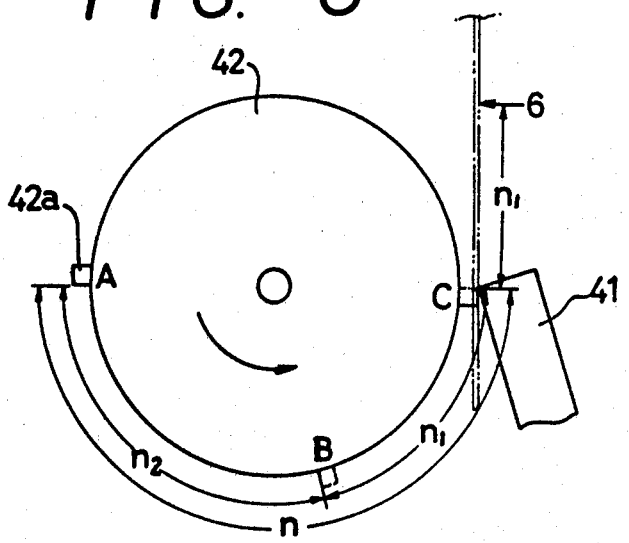

The conditions for calculating the corrected value by the CPU 81 are now described. At the stopped state of the pulse motor $M_2$, the calculating conditions are set as illustrated in FIG. 6. First, during the time period while the edge 42*a* of the rotary blade 42 is rotated from a reference position A to a stationary blade position C, the rotary encoder 56 feeds n pulses to the address counter 80. In the embodiment under consideration, the reference position A and the stationary blade position C are arranged symmetrically with respect to the center of rotation of the rotary blade 42 so that the relationship of $N=2n$ holds. Moreover, after the photoelectric detector $S_1$ has detected one of those portions 4 of the price tag web 1 thereby to generate its signal and before one of the lines 6 of the price tag web 1 to be cut reaches the stationary blade position C, the rotary encoder 56 generates $n_1$ pulses. Moreover, it is assumed here that the edge 42*a* of the rotary blade 42 is at a detected position B when the photoelectric detector $S_1$ generates its signal.

Under the conditions thus far described, there is no necessity for the correction if the counted value of the address counter 80 is $n_2$ (provided that $n_2=n-n_1$) when the signal is generated by the photoelectric detector $S_1$. This is because the time period for the line 6 of the price tag web 1 to reach the stationary blade position C after the signal has been generated by the photoelectric detector $S_1$ is equal to the time period for the edge 42*a* of the rotary blade 42 to reach the stationary blade position C because the number of the output pulses of the rotary encoder 56 for both time periods is $n_1$. When the signal is generated by the photoelectric detector $S_1$, the correction for retarding the rotary blade 42 is performed in case the counted value of the address counter 80 is larger than $n_2$, whereas the correction for advancing the rotary blade 42 is performed in case that counted value is smaller than $n_2$. The constant $n_2$ for effecting the comparisons with the counted value of the address counter 80 in those ways is stored in the CPU 81.

Figure 7:
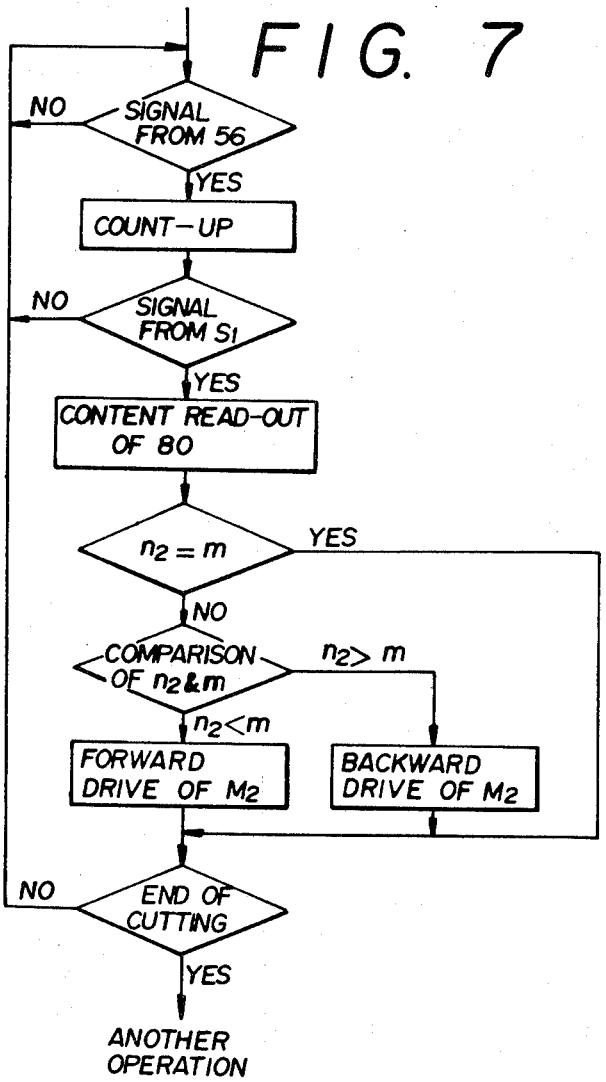

Next, the cutting control operations of the aforementioned control circuit are described with reference to the flow chart of FIG. 7.

First, when the induction motor $M_1$ shown in FIGS. 3 and 4 is started and when the rotary shafts 46 and 47 are connected by the clutch 45, both the feeding operation of the price tag web 1 and the rotations of the rotary blade 42 are started. At these operating states, the CPU 81 monitors the output signal of the rotary encoder 56. Meanwhile, when a signal is generated by the photoelectric converter $S_2$ as the rotary blade 42 reaches the reference position A shown in FIG. 6, the address counter 80 is reset by that signal. When the signal is generated by the rotary encoder 56, moreover, the content of the address counter 80 is counted up by "1", and it is then judged whether there is the output signal of the photoelectric detector $S_1$ or not. In case, at this time, there is no output signal from the photoelectric detector $S_1$, the counting-up operations of the address counter 80 on the basis of the output signal of the rotary encoder 56 are repeated.

Moreover, when the photoelectric detector $S_1$ deflects one of the portions 4 of the price tag web 1, thereby to generate its signal, the CPU 81 judges whether or not the constant $n_2$ stored therein is coincident with the content m of the address counter 80. With the coincidence, it is judged whether the cutting operation is ended or not because there is no necessity for correcting the cutting timing. Without the coincidence, however, the comparison between the constant $n_2$ and the content m of the address counter 80 is performed. If an inequality of $n_2<m$ is found as a result of that comparison, the pulse motor $M_2$ is driven to advance the rotary blade 42 by the rotations of $(m-n_2/N)$. For $n_2>m$, on the contrary, the pulse motor $M_2$ is driven to retard the rotary blade 42 by the rotations of $(n_2-m/N)$. Thus, the cutting timing is corrected.

When the correction of the cutting timing is ended, it is judged whether the cutting operation itself is ended. If the cutting operation is judged not to be ended, the correction of the cutting timing is performed again in a similar manner. If the cutting operation is judged to be ended, on the contrary, another operation is performed.

As has been described hereinbefore, the cutting device of the price tag printer according to the present invention is constructed so that the rotary blade is rotationally driven though the differential gear mechanism by the first motor or the induction motor and that the cutting timing is corrected by the second motor or the pulse motor which is connected to the differential gear mechanism. As a result, corrections are accurately made, despite errors in the cutting timing under any condition, so that the price tag web can always be cut at its desired cut lines.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A cutting device for cutting tags, or the like, from a continuous web thereof, the device comprising:

means for feeding a tag web along a path;

a rotary blade positioned at a fixed location along the path and being rotatable about a rotary axis, and including a cutting blade projecting outwardly thereof and extending generally axially thereof, the cutting blade being placed for engaging the web as the rotary blade rotates past the web, and the cutting blade being for severing the web as the blade engages the web;

a first motor for continuously rotating the rotary blade about its axis; a first power transmission mechanism connected to the first motor for transmitting the rotation of the first motor;

a differential gear mechanism connected between the first power transmission mechanism and the rotary blade for rotating the rotary blade when the differential gear mechanism is operated through the first power transmission mechanism;

timing control means for adjusting the rotation of the rotary blade, thereby to correct the cutting timing; the timing control means including a second motor operable independently of the first motor, a second power transmission mechanism connected between the second motor and the differential gear mechanism for operating the differential gear mechanism to change the rotation of the rotary blade; and reference position means including tag positioning means for positioning the tag web at a reference position thereof, and a rotary blade positioning means for positioning the rotary blade at a respective reference position thereof, the tag positioning means including a limit switch for detecting whether the tag web is in its reference position, and the rotary blade positioning means comprising a brake for braking the rotary blade when it is controlled.

2. The cutting device of claim 1, wherein the timing control means includes a first detector for sensing the location of tags along the web providing a signal responsive thereto and second means responsive to the rotation orientation of the rotary blades and also providing a signal responsive thereto; and means for receiving the signals provided by the first detector and the second means and for operating the second motor for correcting the rotation of the rotary blade according to the signals received by the receiving means.

3. In combination, the cutting device of claim 2 and a tag web, the tag web being formed of a plurality of tags arranged serially along its length and the tag web further being formed at intervals equal to the length of one tag with portions of the tag to be detected by the first detector.

4. The cutting device of claim 1, further comprising a printing device for printing each tag being fed.

5. The cutting device of claim 1, wherein the differential gear mechanism includes a timing pulley acting as a ring gear of the differential gear mechanism; the timing pulley being connected to the second power transmission mechanism and also being rotatable with the rotary blade; a first bevel gear acting as a differential side gear of the differential gear mechanism; the first bevel gear being connected to the rotary blade so that it can rotate with the rotary blade; a second bevel gear acting as a differential side gear of the differential gear mechanism; the second bevel gear being connected to the first power transmission mechanism and being rotatable coaxially with but independently of the rotary blade; and a pair of third and fourth bevel gears acting as differential pinion gears of the differential gear mechanism, and being carried in the timing pulley and meshing with said first and second bevel bears.

6. The cutting device of claim 5, wherein the first power transmission mechanism includes a gear train connected between the first motor and the second bevel gear of the differential gear mechanism for transmitting the rotation of the first motor to the second bevel gear; and a clutch disposed within the gear train for being engaged and disengaged for making the power transmission of the first power transmission mechanism effective and ineffective, respectively.

7. The cutting device of claim 5, wherein the second power transmission mechanism includes a second timing pulley rotatable with the shaft of the second motor; and a timing belt which runs on both the second timing pulley and the first mentioned timing pulley of the differential gear mechanism for transmitting the correcting rotation of the second motor to the rotary blade through the differential gear mechanism.

8. The cutting device of claim 1, wherein the timing control means further includes a detector for detecting when a tag on the web attains a predetermined position along the path of the web; encoding means connected with the rotary blade for generating pulse signals in accordance with the rotation of said rotary blade, and a control circuit for receiving the signal of the detector and the signals of said encoding means for controlling the rotation of the second motor for correcting the cutting timing of the rotary blade.

9. The cutting device of claim 8, wherein the control circuit includes an address counter for counting up the number of the pulse signals of the encoding means for generating a signal indicating the rotation position of the rotary blade, a drive circuit for controlling the rotation of the second motor when it is controlled, and a central processing unit for receiving both the counted up number of the address counter and the signal of the detector for calculating a corrected value to control the drive circuit.

10. The cutting device of claim 9, wherein the central processing unit is connected to receive the signal of the limit switch for controlling the brake to control the drive circuit, when the tag web is detected to be out of its reference position, so that the second motor may bring the tag web into the reference position thereof.

11. The cutting device of claim 1, further comprising a stationary blade positioned to oppose the rotary blade along the path of the web, and the stationary blade being adapted to be engaged by the rotary blade for cutting of the web.

12. A cutting device for cutting tabs, or the like, from a continuous web thereof, the device comprising;

means for feeding a tag web along a path;

a rotary blade positioned at a fixed location along the path and being rotatable about a rotary axis, and including a cutting blade projecting outwardly thereof and extending generally axially thereof, the cutting blade being placed for engaging the web as the rotary blade rotates past the web, and the cutting blade being for severing the web as the blade engages the web;

a first motor for continuously rotating the rotary blade about its axis; a first power transmission mechanism connected to the first motor for transmitting the rotation of the first motor;

a differential gear mechanism connected between the first power transmission mechanism and the rotary blade for rotating the rotary blade when the differential gear mechanism is operated through the first power transmission mechanism;

timing control means for adjusting the rotation of the rotary blade, thereby to correct the cutting timing; the timing control means including a second motor operable independently of the first motor; a second power transmission mechanism connected between the second motor and the differential gear mechanism for operating the differential gear mechanism to change the rotation of the rotary blade; a first detector for detecting when a tag on the web attains a predetermined position along the path of the web; encoding means connected with the rotary blade for generating pulse signals in accordance with the rotation of said rotary blade; and a control circuit for receiving the signal of the first detector and the signals of said encoding means for controlling the rotation of the second motor for correcting the cutting timing of the rotary blade, the control circuit including an address counter for counting up the number of the pulse signals of the encoding means for generating a signal indicating the rotation position of the rotary blade, a drive circuit for controlling the rotation of the second motor when it is controlled, and a central processing unit for receiving both the counted-up number of the address counter and the signal of the detector for calculating a corrected value to control the drive circuit; and reference position means including tag positioning means for positioning the tag web at a reference position thereof, and a rotary blade positioning means for positioning the rotary blade at a respective reference position thereof, the rotary blade positioning means including a second detector for detecting whether the rotary blade is in its reference position, and a second brake for braking the first power transmission mechanism when it is controlled.

13. The cutting device of claim 12, wherein the central processing unit is for receiving the signal of the second detector for controlling the second brake to control the drive circuit, when the rotary blade is detected to be out of its reference position, so that the second motor may rotate the rotary blade to the reference position thereof, until the central processing unit receives the signal of the second detector.

* * * * *